US006067014A

United States Patent [19]

Wilson

[11] Patent Number: 6,067,014

[45] Date of Patent: May 23, 2000

[54] CORD TAMPER METHOD AND APPARATUS

[76] Inventor: Edwin P. Wilson, 8147 Post Rd., Allison Park, Pa. 15101

[21] Appl. No.: 08/695,010

[22] Filed: Aug. 9, 1996

[51] Int. Cl.[7] ..... G08B 21/00

[52] U.S. Cl. ..... 340/540; 340/547; 340/568.3; 340/687; 340/568.4; 439/344; 379/44

[58] Field of Search ..... 340/687, 652, 340/568, 571, 547, 540, 521, 531; 335/205; 439/344, 676; 379/438, 44, 437, 445; 361/654, 672; 324/419

[56] References Cited

U.S. PATENT DOCUMENTS

| | | | |
|---|---|---|---|
| D. 313,970 | 1/1991 | Reeves | D13/147 |
| 4,862,500 | 8/1989 | May | 379/445 |
| 4,935,725 | 6/1990 | Turnau | 340/568 |
| 4,943,799 | 7/1990 | Papineau | 340/521 |
| 5,142,269 | 8/1992 | Mueller | 340/568 |
| 5,254,973 | 10/1993 | Gilmore, II | 340/547 |
| 5,519,756 | 5/1996 | Clift | 379/44 |
| 5,525,965 | 6/1996 | Liebenthal | 340/568 |

*Primary Examiner*—Jeffery A. Hofsass
*Assistant Examiner*—Davetta Woods
*Attorney, Agent, or Firm*—Ansel M. Schwartz

[57] ABSTRACT

The present invention pertains to a security system. The system comprises a detector for producing an alarm signal. The system comprises a cord connected to the detector along which the alarm signal is transmitted. The system comprises a mechanism for securing the cord to a communication jack which produces an alarm when the cord is separated from the communication jack.

5 Claims, 4 Drawing Sheets

CORD TAMPER METHOD AND APPARATUS

FIELD OF THE INVENTION

The present invention relates to alarm circuits. More specifically, the present invention relates to an apparatus that enables an alarm user to attach an alarm system, in a tamper proof fashion to any conventional modular telephone jack.

BACKGROUND OF THE INVENTION

With the advent of the use of computers and their associated accessories, a proliferation of expensive but highly portable equipment, that needs to be secured from theft, such as laptop and handheld computers, external CD ROM and floppy drives, and tape backup devices have appeared in such places as offices, schools, laboratories and on display in retail stores. In addition, there is a need for security systems which need to be located in the aforementioned locations as well as in motel and hotel rooms, in small offices, and in college student dorm rooms where it is extremely difficult to find a location where the alarm central processing unit (CPU) can be securely located so that a thief cannot have access to it or defeat it simply by disconnecting its connecting cord that attaches it to the telephone network. Traditional locks have been used to secure such equipment, but it is not always possible to have someone present to make sure that a thief cannot compromise such equipment without attracting attentions. The present invention is an apparatus that enables the user to very easily, without the use of any tools, attach his alarm system to any existing modular phone jack circuit in a secure tamper proof fashions.

In addition to various versions of surface and recessed flush mounted RJ31X connecting blocks, there is a non-tamper proof modular duplex adaptor version (Formosa's Data Communications & Telephone Accessories Model F248A and F248AJ) which can be plugged into the commonly found conventional 6 position 4 conductor modular phone jack. The invention herein described provides a tamper proof circuit which will instantly trip an alarm circuit if anyone either attempts to remove the connecting cord from this specially wired modular duplex adaptor, or if they attempt to remove the modular duplex adaptor from the commonly found phone company supplied modular telephone phone jack.

The present invention will cause an alarm condition if anyone attempts to remove the alarm cord from the modular adaptor or if anyone attempts to remove the modular adaptor from the standard telephone company supplied telephone jack. Due to its unique design, the apparatus can be installed by anyone who has little, if any, electrical knowledge in less than one minute without the use of any tools.

SUMMARY OF THE INVENTION

The present invention pertains to a security system. The system comprises a detector for producing an alarm signal. The system comprises a cord connected to the detector along which the alarm signal is transmitted. The system comprises a mechanism for securing the cord to a communication jack which produces an alarm when the cord is separated from the communication jack. Additionally, the security system comprises a communication jack which connects with the securing mechanism. Also, the system comprises a communication line connected to the communication jack.

The present invention pertains to a method for securing a communication cord to a communication line. The method comprises the steps of connecting the alarm cord to a modular adaptor. Next, there is the step of connecting the modular adaptor to the communication line. Then, there is the step of producing an alarm signal if the cord is separated from the communication line.

The present invention pertains to a tamper proof apparatus for connecting a communication line to a wall jack. The apparatus comprises a modular adaptor having a plug for engaging in communication with a receptacle of the wall jack and a first receptacle jack for engaging in communication with the communication line. The modular adaptor has an internal wiring connecting wires of the plug to wires of the first receptacle jack in a magnetically activated switch connected across two wires of the first receptacle jack. Additionally, the apparatus comprises a magnet for attaching to the wall jack adjacent to the modular adaptor such that when the modular adaptor is engaged within the wall jack within influence of the magnet, the switch is closed and when the modular adaptor is removed from the phone jack, out of influence of the magnet, the switch opens.

The present invention pertains to an apparatus for connecting an alarm system cord to a communication jack. The apparatus comprises a modular adaptor having a plug for engaging in communication with the communication jack and a receptacle jack for engaging in communication with the alarm system cord. Additionally, the apparatus comprises a tamper circuit mechanism for indicating if the plug is removed from the communication jack and if the alarm system cord is removed from the modular adaptor. The tamper circuit mechanism is connected to the modular adaptor.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
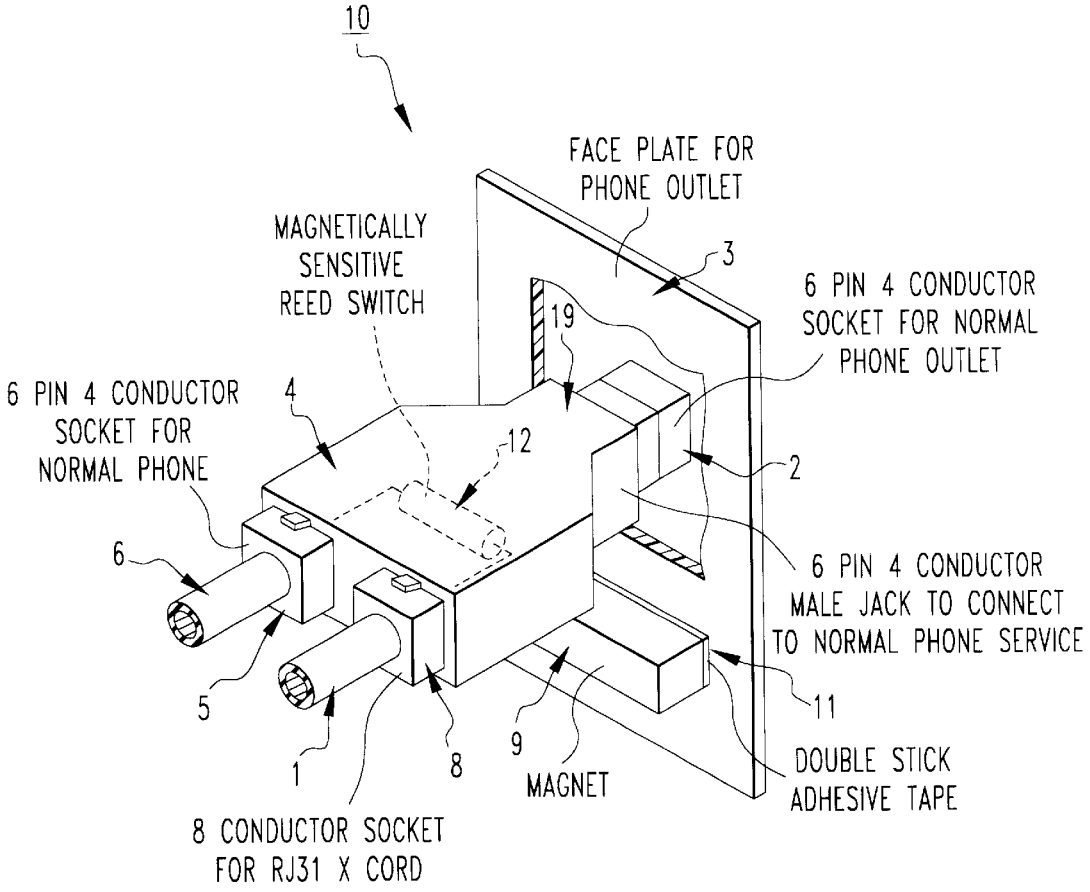
FIG. 1 is a schematic representation of an apparatus for connecting an alarm system cord to a communication jack.
Figure 3A:
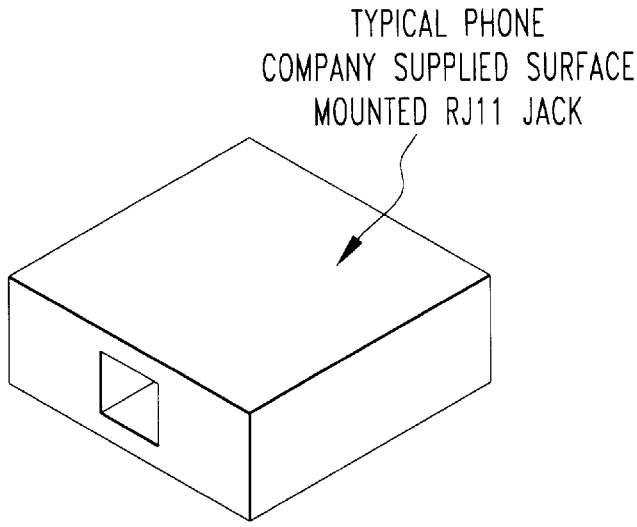
FIG. 3*a* is a schematic representation of a typical phone company supplied surface mounted RJ11 jack.
Figure 3B:
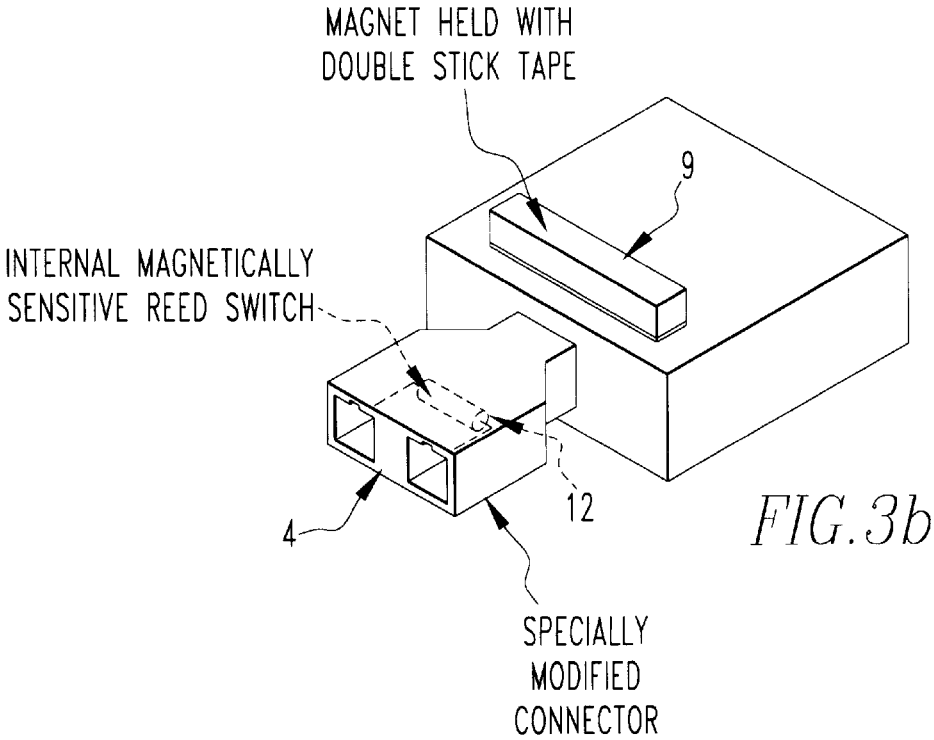
FIG. 3*b* is a schematic representation of an alternative embodiment of the present invention.
Figure 4:
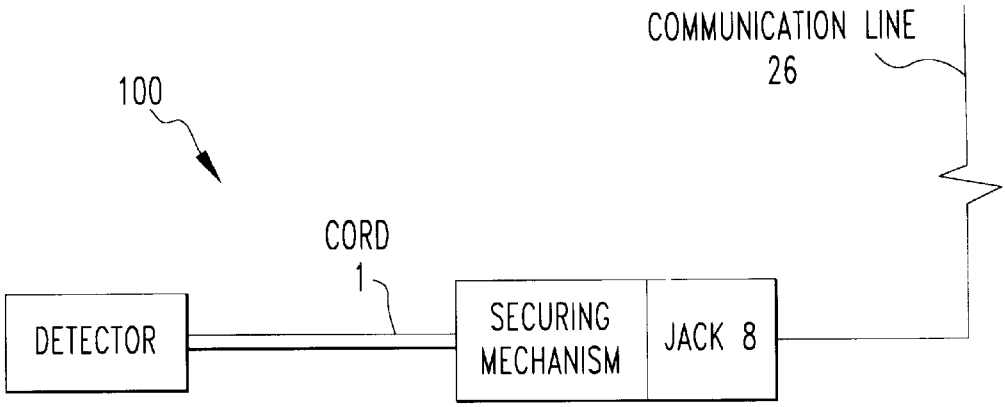
FIG. 4 is a schematic representation of a system of the present invention.

Referring now to the drawings wherein like reference numerals refer to similar or identical parts throughout the several views, and more specifically to FIGS. 1, 3*b* and 4 thereof there is shown a security system 100. The system 100 comprises a detector for producing an alarm signal. The system 100 comprises a cord, such as a RJ31X connecting cord 1, connected to the detector, such as an ITI Ultragard™ CPU, along which the alarm signal is transmitted. The system 100 comprises a mechanism, such as an apparatus 10 described below, for securing the cord to a communication jack, such as a phone jack 8, which produces an alarm when the cord is separated from the communication jack. Additionally, the security system 100 comprises a communication jack which connects with the securing mechanism. Also, the system 100 comprises a communication line, such as a phone or cable line 26, connected to the communication jack.

Figure 5:
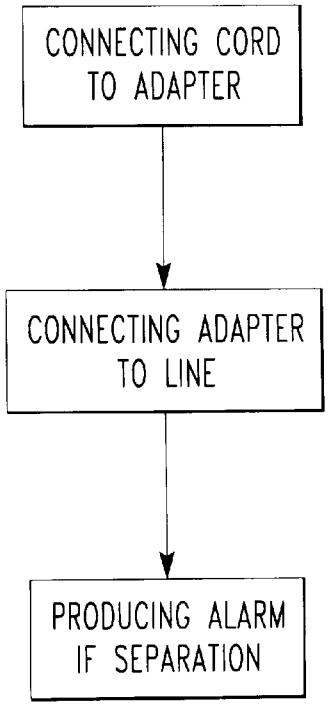
FIG. 5 is a flow chart in regard to the present invention.

The present invention pertains to a method for securing a communication cord to a communication line, as shown in FIG. 5. The method comprises the steps of connecting the alarm cord to a modular adaptor 4. Next, there is the step of connecting the modular adaptor 4 to the communication line. Then, there is the step of producing an alarm signal if the cord is separated from the communication line.

The present invention pertains to a tamper proof apparatus for connecting a communication line to a wall jack. The apparatus comprises a modular adaptor 4 having a plug for engaging in communication with a receptacle of the wall jack and a first receptacle jack for engaging in communication with the communication line. The modular adaptor 4 has an internal wiring connecting wires of the plug to wires of the first receptacle jack in a magnetically activated switch connected across 2 wires of the first receptacle jack. Additionally, the apparatus comprises a magnet 9 for attaching to the wall jack adjacent to the modular adaptor 4 such that when the modular adaptor 4 is engaged within the wall jack within influence of the magnet 9, the switch is closed and when the modular adaptor 4 is removed from the phone jack 2, out of influence of the magnet 9, the switch opens.

The modular adaptor 4 preferably comprises a second receptacle jack for engaging in communication with a second communication line. The second receptacle jack having wires in communication with the internal wiring. Preferably, the switch comprises a reed switch.

The present invention pertains to an apparatus for connecting an alarm system 100 cord to a communication jack. The apparatus comprises a modular adaptor 4 having a plug for engaging in communication with the communication jack and a receptacle jack for engaging in communication with the alarm system 100 cord. Additionally, the apparatus comprises a tamper circuit mechanism for indicating if the plug is removed from the communication jack and if the alarm system 100 cord is removed from the modular adaptor 4. The tamper circuit mechanism is connected to the modular adaptor 4.

Preferably, the tamper circuit mechanism comprises internal wiring connecting wires of the plug to wires of the first receptacle jack and a magnetically activated switch connected across 2 wires of the first receptacle jack. Moreover, the tamper circuit mechanism preferably comprises a magnet 9 for attaching to the wall jack adjacent to the modular adaptor 4 such that when the modular adaptor 4 is engaged within the wall jack within influence of the magnet 9, the switch is closed and when the modular adaptor 4 is removed from the phone jack 2 out of influence of the magnet 9, the switch opens. Preferably, the modular adaptor 4 comprises a second receptacle jack for engaging in communication with a second communication line. The second receptacle jack having wires in communication with said internal wiring.

In the operation of the preferred embodiment, and with reference to FIG. 1 there is an apparatus 10 for linking an RJ31X connecting cord 1 to a telephone company supplied phone jack 2 that is flush mounted on a face plate 3. The modular duplex adaptor 4 is plugged into the modular phone jack 2 and the phone cord 6 that formerly was plugged into the modular phone jack 2 has been unplugged from jack 2 and is now plugged into modular receptacle jack 5 of adaptor 4. The RJ31X connecting cord 1 is plugged into receptacle jack 8 of duplex adaptor 4 and magnet 9 is attached to face plate 3 just below adaptor 4 using double stick tape 11. For a more permanent installation, if a strong magnet is used the face plate 3 may be temporarily removed and the magnet may be placed on the back side of face plate 3 which is then reattached to its mounting bracket (not shown). The magnetic field of magnet 9 causes the small magnetically activated reed switch 12 to close.

Figure 2:
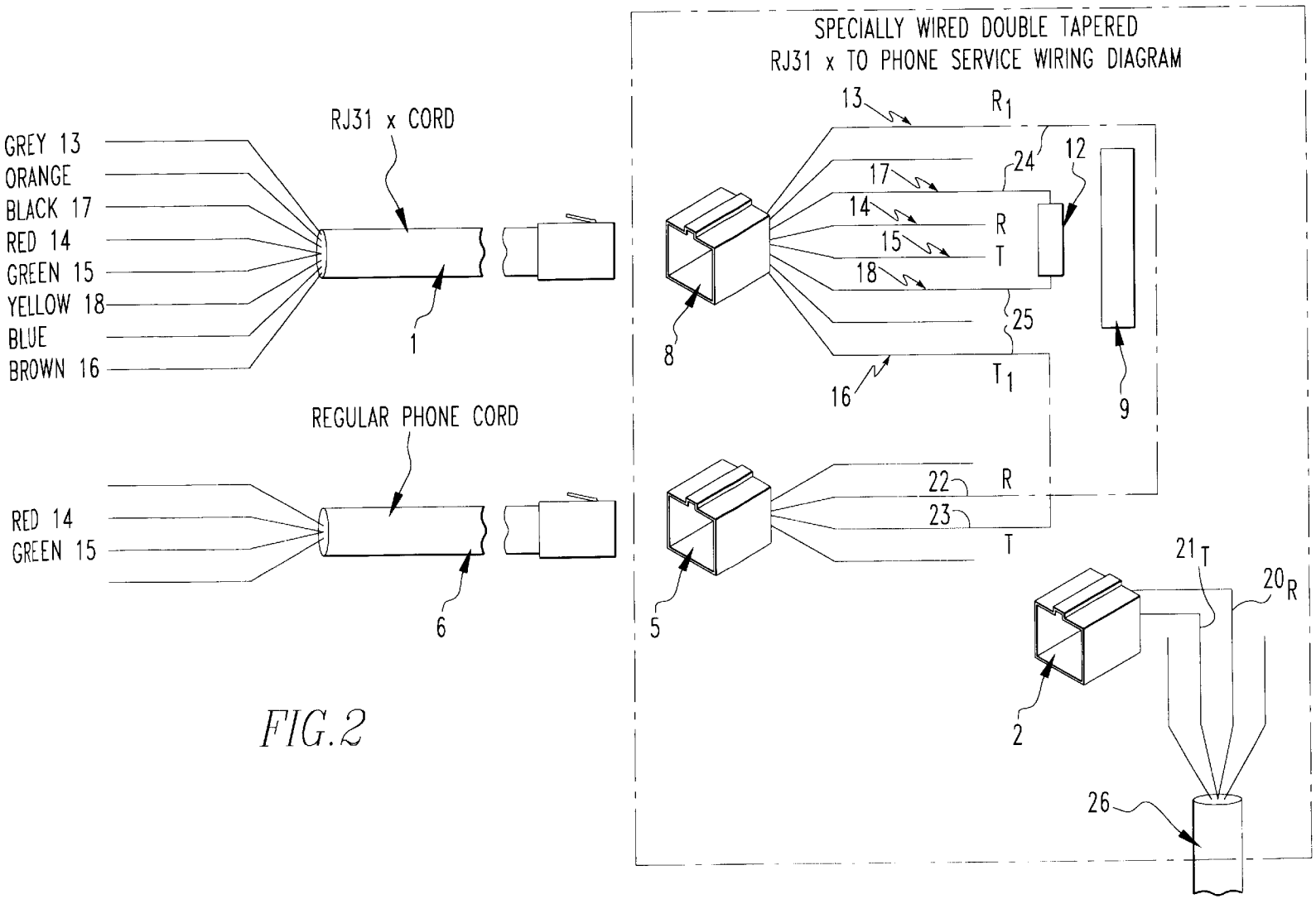
FIG. 2 is a schematic representation showing the wiring circuit of the apparatus.

Referring to FIG. 2 connecting cord RJ31X is an eight conductor cord that is normally connected to an alarm system by using the gray 13(R1), red 14 (R), green 15 (T) and brown 16 (T1) wires. Reed switch 12 is shown to be connected between black wire 17 and yellow wire 18 and is held in the closed position by magnet 9. The six position 4 conductor plug 19 at the back of duplex adaptor 4 is plugged into jack 2 to which the ring 20 (R) and tip 21 (T) is supplied by the phone company through wire 26. The other two wires in the jack are not normally used unless a second phone line is being supplied by the phone company through wire 26.

When the modular duplex adaptor 4 is installed into jack 2 the (R) 20 from the phone company, due to the positioning of the contacts of the plugs and jacks, becomes wired straight through to (R) 14 of the jack 8 of the modular duplex adaptor 4 and the (T) 21 from the phone company becomes wired straight through to (T) 15 of the jack 8 of the modular duplex adaptor 4.

Inside the modular duplex adaptor 4 the (R1) 13 is wired to (R) 22 of jack 5 and (T1) 16 is wired to (T) 21 of jack 5. Two shorting bars 24 and 25 are provided inside the modular duplex adaptor 4 so that if the RJ31X connecting cord 1 is removed from jack 8 of the modular duplex adaptor 4 the (R) 20 from the phone company will be switched to (R) 22 of jack 5 through shorting bar 24 and (T) 21 from the phone company will be switched to (T) 23 of jack 5 through shorting bar 25 thus allowing any associated phone to continue to work if the alarm system is disconnected from the modular duplex adaptor 4. However, since the black wire 17 is connected through closed reed switch 12 to yellow wire 18 inside the modular duplex adaptor 4 that loop will become open if RJ31X cord 1 is removed from jack 8 and will cause the sensing circuits of the alarm system (not shown) to sound its siren. Likewise, if the modular duplex adaptor 4 is removed from phone jack 2, the reed switch 12 will be pulled away from magnet 9 causing reed switch 12 to open thus causing an open between black wire 17 and yellow wire 18 which can be sensed by the sensing circuits of the alarm system (not shown) to sound its siren.

The normal operation of the alarm system (not shown) provides that when the alarm system CPU begins to send data through the RJ31X 1 phone cord to the telephone company provided network, the (R1) and (T1) lines are disconnected within the alarm system CPU so that the associated phone can not disrupt the outgoing call, and if a call was in process, it would be disconnected so that the alarm call could go out through the telephone company provided network.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A tamper proof apparatus for connecting a communication line to a wall jack comprising:

a modular adaptor having a plug for engaging in communication with a receptacle of the wall jack and a first receptacle jack for engaging in communication with the communication line, said modular adaptor having an internal wiring connecting wires of the plug to wires of the first receptacle jack and a magnetically activated switch connected across two wires of the first receptacle jack; and a magnet for attaching to the wall jack adjacent to the modular adaptor such that when the modular adaptor is engaged within the wall jack within influence of the magnet, the switch is closed and when the modular adaptor is removed from the phone jack, out of influence of the magnet, the switch opens.

2. A tamper proof apparatus as described in claim 1 wherein the modular adaptor comprises a second receptacle jack for engaging in communication with a second communication line, said second receptacle jack having wires in communication with said internal wiring.

3. A tamper proof apparatus as described in claim 2 wherein said switch comprises a reed switch.

4. An apparatus for connecting an alarm system cord to a communication jack comprising:

a modular adaptor having a plug for engaging in communication with the communication jack and a first receptacle jack for engaging in communication with the alarm system cord; and a tamper circuit mechanism for indicating if the plug is removed from the communication jack and if the alarm system cord is removed from the modular adaptor, said tamper circuit mechanism connected to said modular adaptor but sensing remotely if the plug is removed from the communication jack;

the tamper circuit mechanism comprises internal wiring connecting wires of the plug to wires of the first receptacle jack and a magnetically activated switch connected across two wires of the first receptacle jack; and a magnet member for attaching to the wall jack adjacent to the modular adaptor such that when the modular adaptor is engaged within the wall jack within influence of the magnet the switch is closed and when the modular adaptor is removed from the phone jack, out of influence of the magnet, the switch opens.

5. An apparatus as described in claim 4 wherein the modular adaptor comprises a second receptacle jack for engaging in communication with a second communication line, said second receptacle jack having wires in communication with said internal wiring.

* * * * *